US006186361B1

(12) United States Patent
Teetsel, III

(10) Patent No.: US 6,186,361 B1
(45) Date of Patent: Feb. 13, 2001

(54) LIQUID DISPENSER

(75) Inventor: Charles F. Teetsel, III, Phoenix, AZ (US)

(73) Assignee: Creamiser Products Corporation, Pheonix, AZ (US)

( * ) Notice: Under 35 U.S.C. 154(b), the term of this patent shall be extended for 0 days.

(21) Appl. No.: 09/510,936

(22) Filed: Feb. 22, 2000

Related U.S. Application Data

(60) Continuation-in-part of application No. 09/225,257, filed on Jan. 4, 1999, now Pat. No. 6,026,988, which is a division of application No. 08/811,135, filed on Mar. 3, 1997, now Pat. No. 5,855,298, which is a continuation of application No. 08/292,732, filed on Aug. 18, 1994, now abandoned.

(51) Int. Cl.[7] ..... B67D 5/00

(52) U.S. Cl. ..... 222/1; 222/146.6; 222/181.1; 222/214; 222/105

(58) Field of Search ..... 222/1, 81, 82, 222/83, 83.5, 88, 86, 105, 146.6, 107, 108, 181.1, 214, 212; 141/330

(56) References Cited

U.S. PATENT DOCUMENTS 2,831,610 * 4/1958 Dennie ..... 222/107 X
2,895,653 * 7/1959 Giepen ..... 222/88 X
3,035,737 * 5/1962 Speas ..... 222/88 X
3,212,681 * 10/1965 Weikert ..... 222/183
3,358,883 * 12/1967 Loe ..... 222/86
4,341,328 * 7/1982 Redick, Jr. ..... 222/83.5
4,557,399 * 12/1985 Redick, Jr. ..... 222/83.5
4,907,723 * 3/1990 Katz ..... 222/105
5,855,298 * 1/1999 Teetsel, III et al. ..... 222/81
5,938,078 * 8/1999 Dprseu et al. ..... 222/105
6,026,988 * 2/2000 Teetsel, III et al. ..... 222/108

* cited by examiner

*Primary Examiner*—Kenneth Bomberg
(74) *Attorney, Agent, or Firm*—Richard E. Oney

(57) ABSTRACT

A liquid dispenser for use with a disposable liquid supply container and a method of using the dispenser is described. The dispenser regulates the flow of liquid by way of a clamping device which substantially seals the liquid from the ambient air. A support for holding the container in an elevated position above the clamping device contains guide flanges which are used to adjust the area in which the container is positioned in the dispenser to accommodate several volume sizes. The liquid flows from the container by gravity through a connector passage which is regulated by the clamping device. In a preferred embodiment, a cooling device is provided to cool the liquid as it flows from the container.

16 Claims, 9 Drawing Sheets

LIQUID DISPENSER

RELATED APPLICATIONS

This application is a continuation-in-part of U.S. Ser. No. 09/225,257, filed Jan. 4, 1999, now U.S. Pat. No. 6,026,988, which is a division of U.S. Ser. No. 08/811,135, which is a continuation of U.S. Ser. No. 08/292,732, filed Aug. 18, 1994, now abandoned.

FIELD OF THE INVENTION

This invention pertains to dispensers for dispensing a liquid food product, such as cream. More particularly, it relates to such a liquid dispenser having a clamping means to regulate liquid flow from the dispenser and a cooling means to cool the liquid to the dispensing point and as it flows from the container.

BACKGROUND OF THE INVENTION

Liquid dispensers are well-known in food service applications. One example of such a liquid dispenser is a cream dispenser. Typically, such dispensers include a dispenser housing, which contains a reservoir for holding the liquid to be dispensed, and a valve assembly for dispensing the cream. Generally, the housing and reservoir are made of stainless steel, plastic, or other durable material acceptable for food contact, and the housing is usually provided with suitable thermal insulation. The reservoir may comprise a container or frame that supports a bag or liner that is pre-filled with the liquid to be dispensed. The liquid stored in the reservoir is cooled in the dispenser by a cooling system, such as a mechanical refrigeration system or refreezable eutectic device.

These existing liquid food dispensers have a number of disadvantages. The metal housings of such dispensers are relatively expensive to manufacture. To use such dispensers having a refillable reservoir, one must fill the reservoir from the carton or other container in which the liquid is packaged.

In the prior application, an inventive cream dispenser was described. The dispenser is relatively inexpensive to manufacture, and it is convenient to use and easier to clean than prior art dispensers having storage reservoirs which require cleaning. In addition, it is relatively compact in size yet can dispense cream from multiple storage containers at one time.

The present invention provides an alternative liquid dispenser, which accommodates a variety of container sizes, provides a means for cooling the liquid as it is dispensed from the various containers and yet is still compact and convenient to use. The dispenser of the present invention is also easy to operate, relatively inexpensive to manufacture and easy to clean. It can be operated using as the reservoir a choice of a refillable container or pre-filled disposable container, including a pre-filled bag or liner.

SUMMARY

A liquid dispenser in accordance with the present invention includes a clamping means for regulating the flow of liquid from the dispenser, support means for holding the container in a substantially elevated position above a sliding closure means and connector means having a passage extending from an opening end through the sliding closure means to a discharge end for communicating with the interior of the container to permit the gravity flow of liquid from the container. In a preferred embodiment, a cooling device is positioned between the sliding closure means and the container for cooling the liquid as it passes through the connector.

In a preferred embodiment of the invention, the container can include a container frame for holding a pre-filled bag or liner. Optionally, the liquid dispenser can include adjustable guide means positioned on the support means for adjusting the area in which the container is held to accommodate at least two volume sizes of the container.

The liquid dispenser also includes means for controlling the temperature of the liquid stored in the container when the container is in the loaded position. In a preferred embodiment, the means for controlling the temperature includes a hermetic refrigeration system. In another embodiment, the means for controlling the temperature includes a heat pump, preferably a thermoelectric module. In still another embodiment, the means for controlling the temperature includes a refreezable eutectic cooling device.

The support means of the dispenser can include a housing having a generally horizontal shelf for supporting a platform having means for vertically slidably receiving the container into the loaded position, at least one upwardly projecting container pedestal for contacting a bottom wall of the container when the container is in the loaded position. Preferably, the platform includes a catch basin having an inclined or slanted bottom providing a low drain point and a drain spout positioned therein for diverting liquid condensation accumulated in the catch basin away from the platform. Also it is preferable that the support means includes means for removably receiving the platform so that the platform can be removed for cleaning.

BRIEF DESCRIPTION OF THE DRAWINGS

These and other features, objects and advantages of the invention will be more fully understood from the following more detailed description, appended claims, and accompanying drawings, in which:

DESCRIPTION

Figure 1:
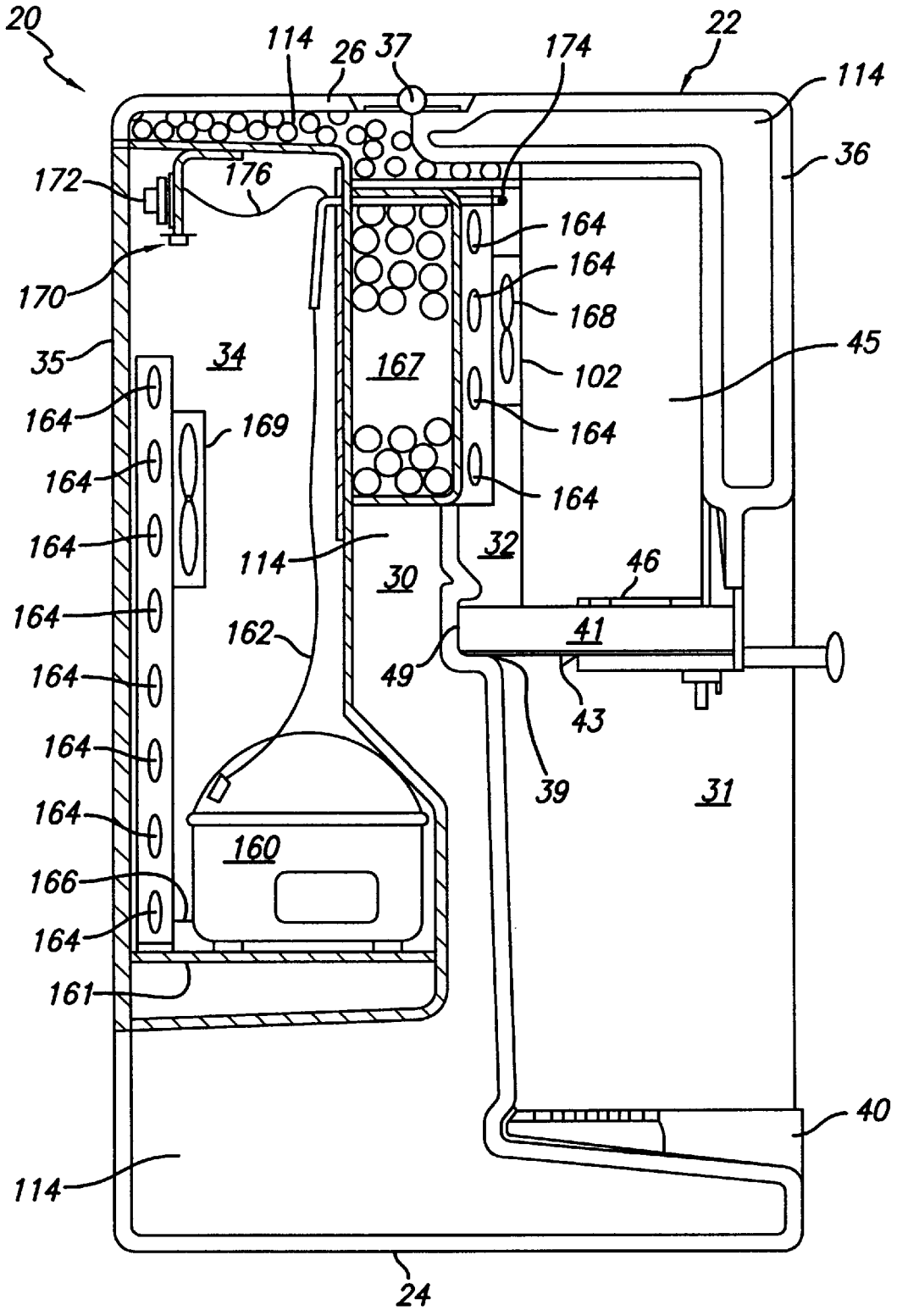
FIG. 1 is a sectional side view of a liquid dispenser in accordance with the invention, showing the relationship of the inventive components and a liquid supply container.
Figure 2:
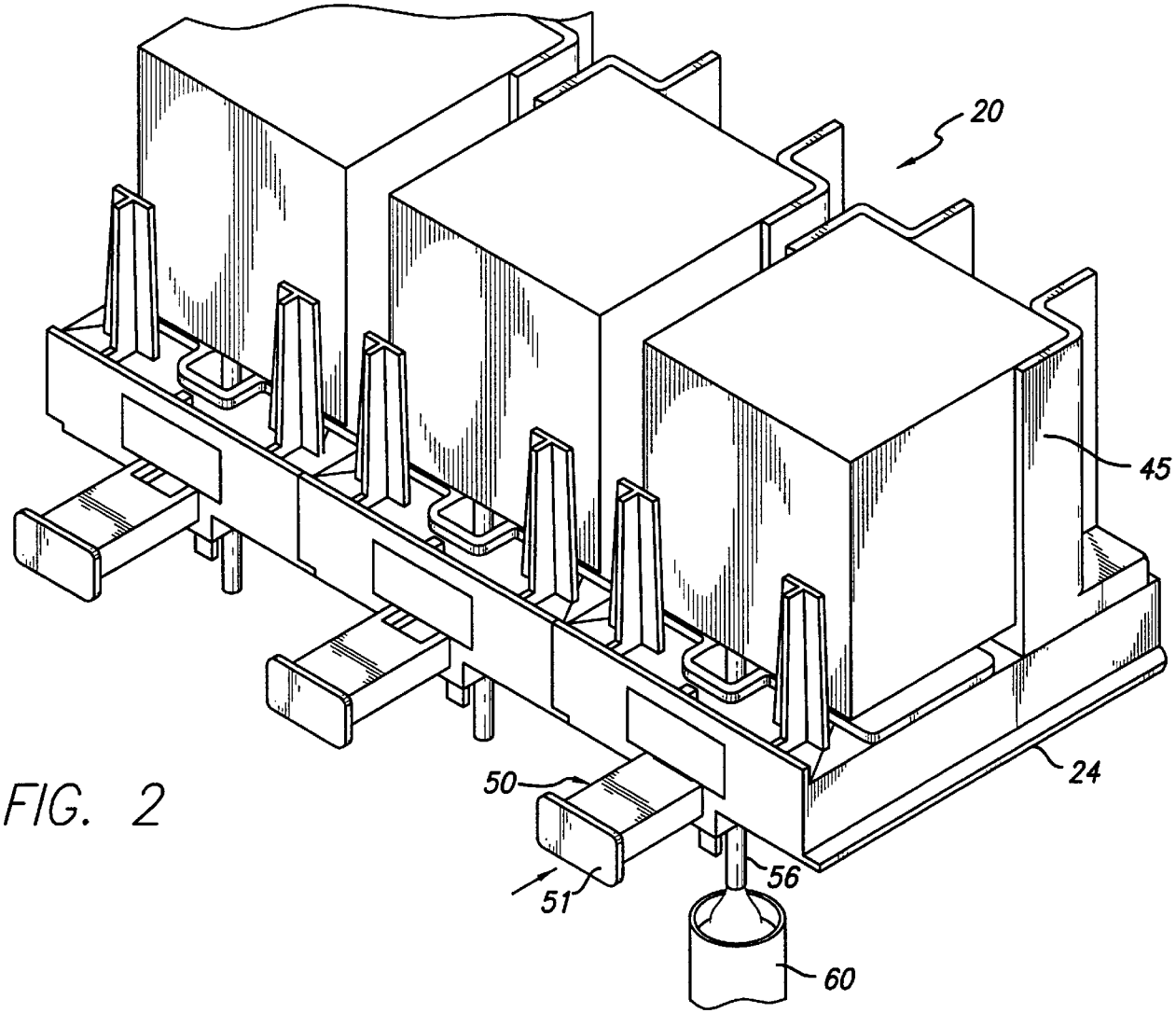
FIG. 2 is a perspective view showing multiple liquid supply containers in loaded positions within a liquid dispenser.

In accordance with the invention, FIGS. 1 and 2 show a preferred embodiment of a liquid dispenser 20 including a housing 22 having a base 24, a top 26 and two generally vertical opposing side walls 28. A generally vertical partition 30, located approximately midway between the front and rear of the housing 22, extends transversally between the side walls 28. A generally horizontal support shelf 39 extends forward from the partition 30. In this configuration, the housing 22 defines a rear compartment 34 having an opening in the back of the housing 22, a liquid storage compartment 32 located in the upper portion of the housing above the shelf 39 opening generally toward the top and front of the housing 22, and a recess 31 located in the lower portion of the housing 22 below the shelf 39 opening toward the front of the housing 22.

The housing 22 includes a removable vented panel 35, which covers the rear compartment 34. A removable drip tray 40 is located in the base 24 in the bottom of the recess 31. The housing 22 also includes a cover 36 adapted to closely fit the opening of the storage compartment 32 and rotatably attached to the housing top 26 by hinges 37. In this configuration, the storage compartment 32 is fully enclosed when the cover 36 is in the lowered, closed position. Access to the storage compartment 32 is achieved by lifting the front of the cover 36 thereby rotating the cover 36 on the hinges 37 into an open position. A latch 38 is adapted to latch the cover 36 in the closed position.

The housing 22 is formed so that the base 24, the top 26, the cover 36, the partition 30 and the support shelf 39 are hollow. Such a construction can be achieved by using a rotational molding process to form the housing 22, preferably from thermoplastic material such as polyethylene. When so constructed, the interior of the housing can be filled with thermal insulating material 114, such as a spray foam insulating material.

Figure 3:
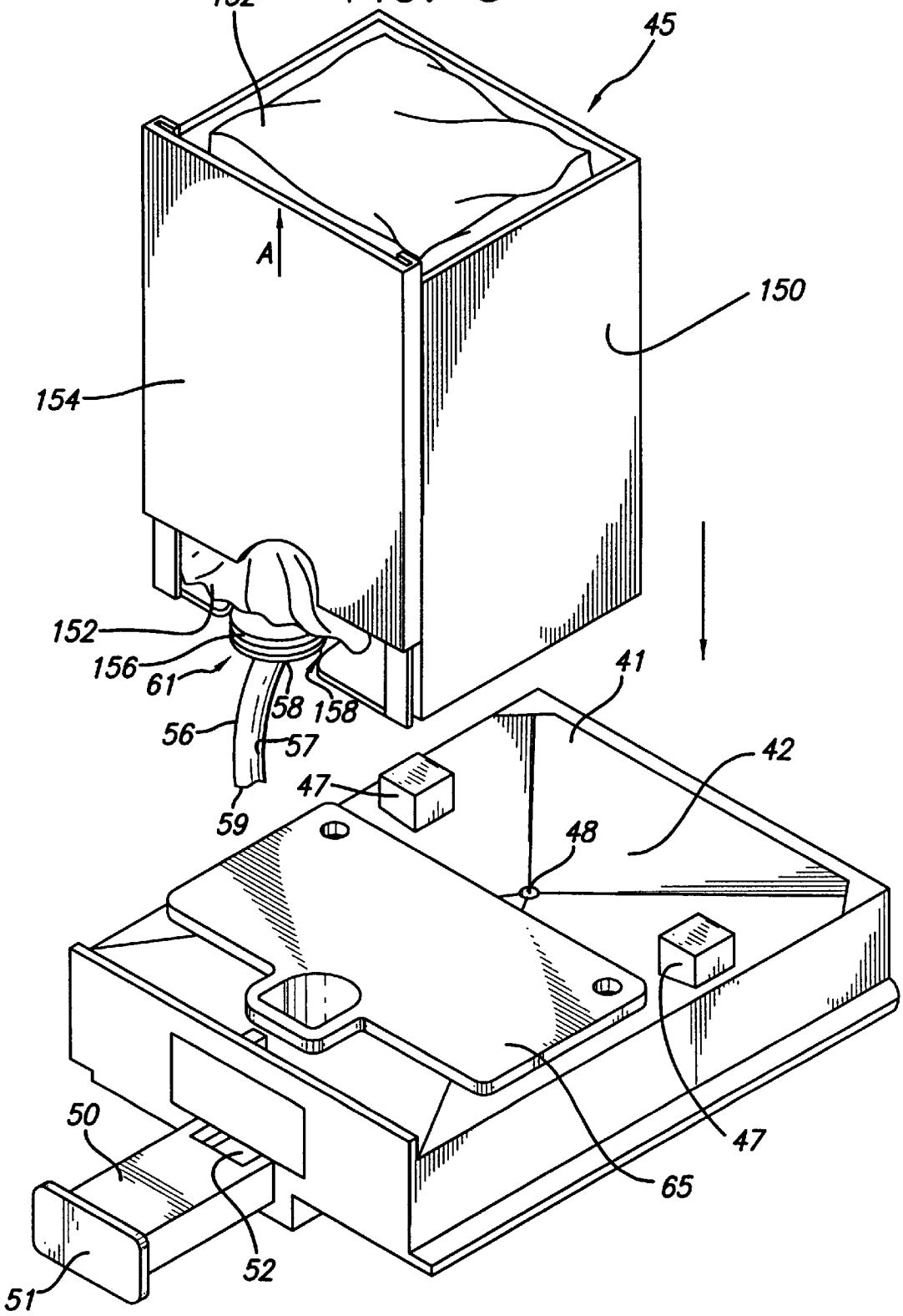
FIG. 3 is an exploded view showing a liquid supply container frame and pre-filled bag in relationship to the support means and clamping means in accordance with the invention.
Figure 4:
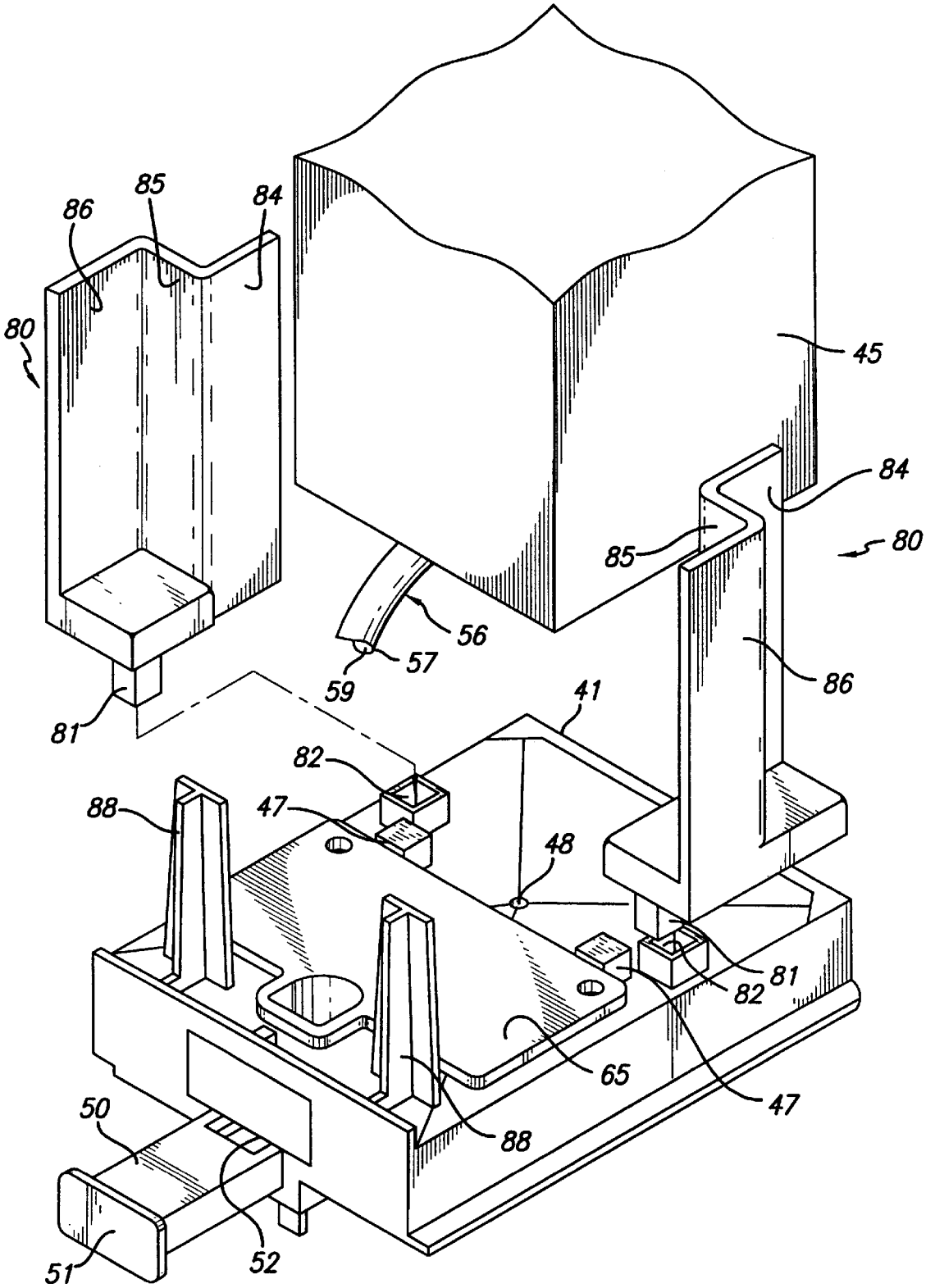
FIG. 4 is an exploded view showing the relationship of a liquid supply container, the adjustable guide means and the clamping means in accordance with the invention.

A removable platform 41 is positioned on top of the support shelf 39. A generally horizontal channel 49 is located in the partition 30 and the side walls 28 adjacent the platform 41 for slidingly receiving the rear edge of the platform 41 and restricting the platform from upward movement. The platform 41 includes a catch basin 42 having an inclined or slanted bottom providing a low drain point and a drain spout 43 which is in overlying relation to the surface of the partition 30 and to a drip tray 40. The platform 41 includes at least one upwardly projecting container pedestal 47 for contacting a container bottom wall 46 when the container 45 is in the loaded position. In one preferred embodiment, as shown in FIG. 4, the platform 41 also includes a plurality of stationary vertical guides 88 and guide means 80 adapted to vertically slidably receive a liquid supply container 45 into a loaded position. In another preferred embodiment, as shown in FIG. 3, the platform 41 does not use guide means. In the preferred embodiments, the platform 41 is composed of injection molded thermoplastic.

Figure 5:
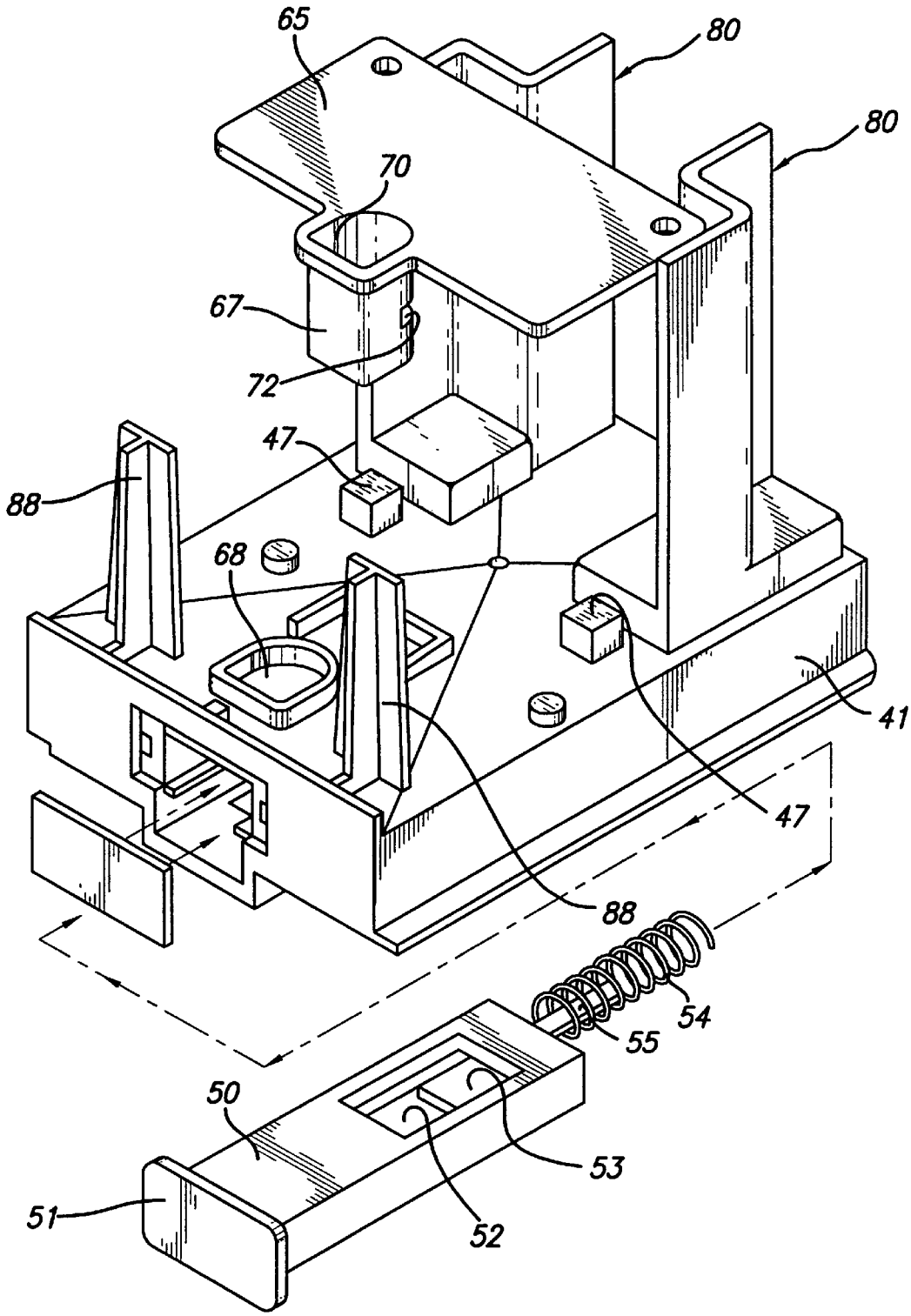
FIG. 5 is an exploded view of the clamping member for regulating the flow of liquid from the dispenser and the cooling means in accordance with our invention.
Figure 6:
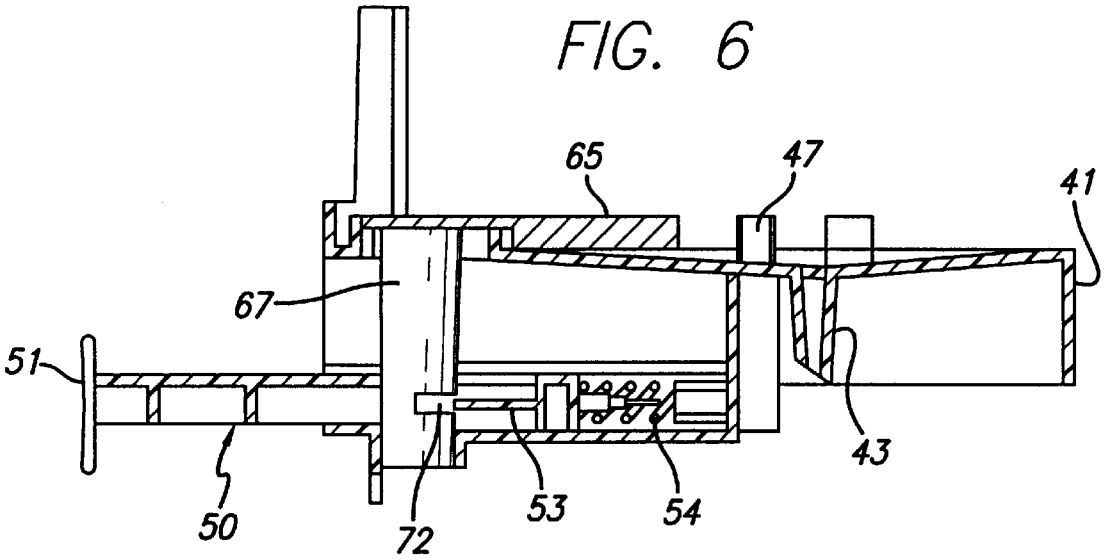
FIG. 6 is a partial sectional side view of the clamping member in the closed position.
Figure 7:
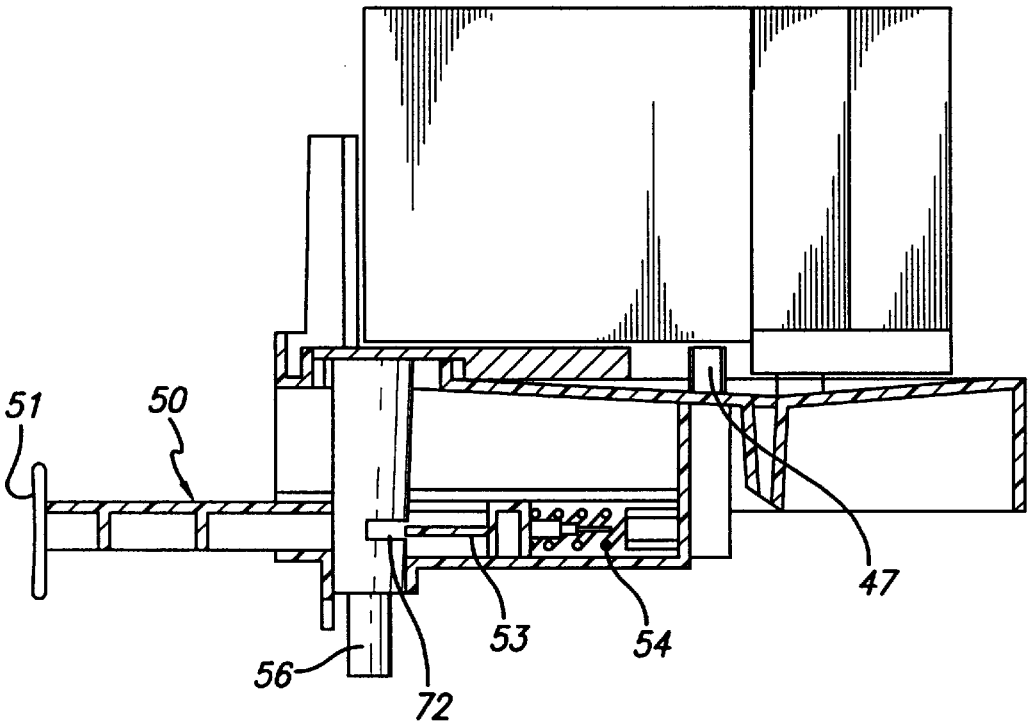
FIG. 7 is a partial sectional side view showing the relationship of the clamping member and a liquid supply container.

As illustrated in FIGS. 2 through 5, the flow of the liquid from the container 45 is regulated by a clamping member 50 having a generally elongated body and a rectangular faced end 51. The clamping member 50 is preferably rectangular and made out of plastic, which may be formed by molding, extrusion or any other conventional means known in the art. In a preferred embodiment, a channel 52 extends through the clamping member 50 and is shaped to preferably accommodate either a connector 56 or a cooling member 65, or both, as described below. A flattened rectangular-shaped gate 53 extends into the channel 52 from one end. Preferably, the gate 53 extends about halfway into the channel 52 as illustrated in FIG. 5. The clamping member 50 is slidably movable along a horizontal axis by any conventional means known in the art, and preferably by a coil spring 54 attached to a pin 55 as illustrated in FIG. 5.

As illustrated in FIGS. 2 through 4, a connector 56 has an opening end 58 in fluid communication with a discharge end 59 by way of a connecting passage 57. The opening end 58 is attached to the container 45. Liquid flowing from the container flows by gravity through the opening end 58 into the passage 57 and, when the connecting passage 57 is open, out the discharge end 59 of the connector 56 into a vessel 60, as desired. In a preferred embodiment, the connector 56 is a tube made of a flexible material, such as polyvinylchloride or rubber. The diameter of the connector determines the speed of the liquid flow and is preferably less than one-half inch in diameter. The opening end 58 is connected to an opening means 61 of the container 45 as is known in the art. Preferably, the opening means includes a non-flexible tube (not shown) made of plastic or metal extending from the container 45. The opening end 58 of the connector 56 snugly fits over the tube to form an airtight seal. By this means the connector 56 may be easily disconnected from the tube for cleaning and to replace the connector 56.

Figure 8:
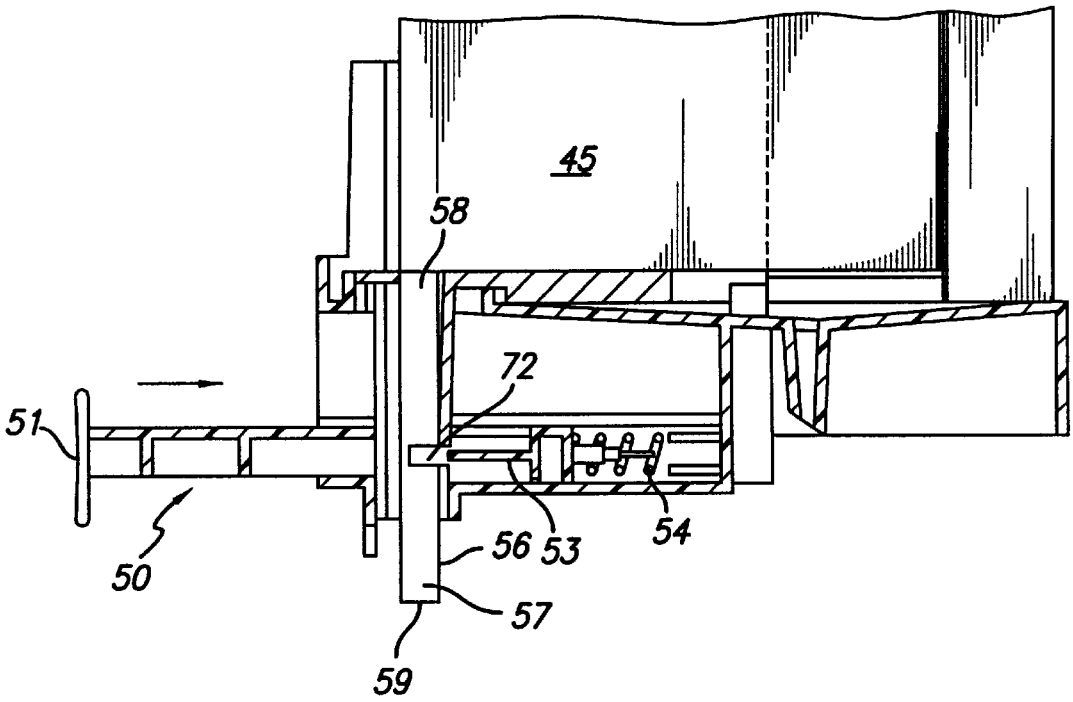
FIG. 8 is a partial sectional side view illustrating the connector of the liquid supply container extending through the clamping member, which is in the open position.

In a preferred embodiment, the connector 56 extends from the container 45 through the channel 52 of the clamping member 50, as illustrated in FIG. 5. By this means the clamping member 50 controls the flow of the liquid. When the clamping member 50 is in a closed position (FIG. 9), the tension of the compressed coil spring 54 urges the gate 53 into the channel 52 to clamp the passage 57 of the connector 56 tightly closed, thereby preventing the gravity flow of the liquid. When the faced end 51 of the clamping means 50 is depressed by a user, as shown in FIG. 8, the spring 54 is compressed further and the gate 53 is disengaged from the connector 56. This opens the passage 57 and permits the gravity flow of the liquid from the container 45.

Figure 9:
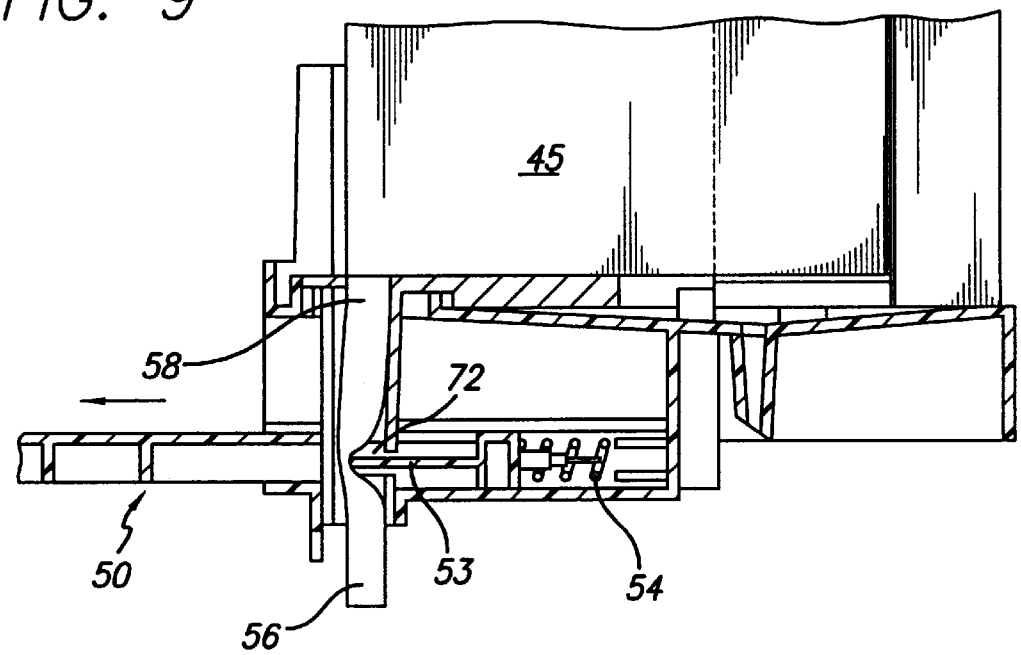
FIG. 9 is a partial sectional side view illustrating the connector of the liquid supply container extending through the clamping member, which is in the closed position.
Figure 10:
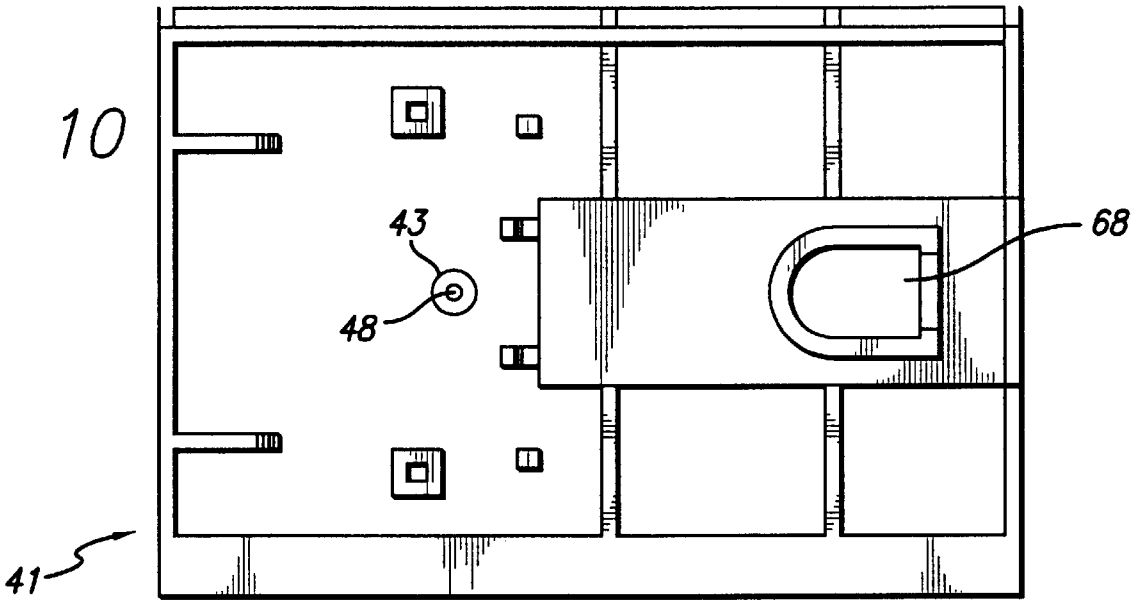
FIG. 10 is a bottom plan view of the platform of the dispenser.
Figure 11:
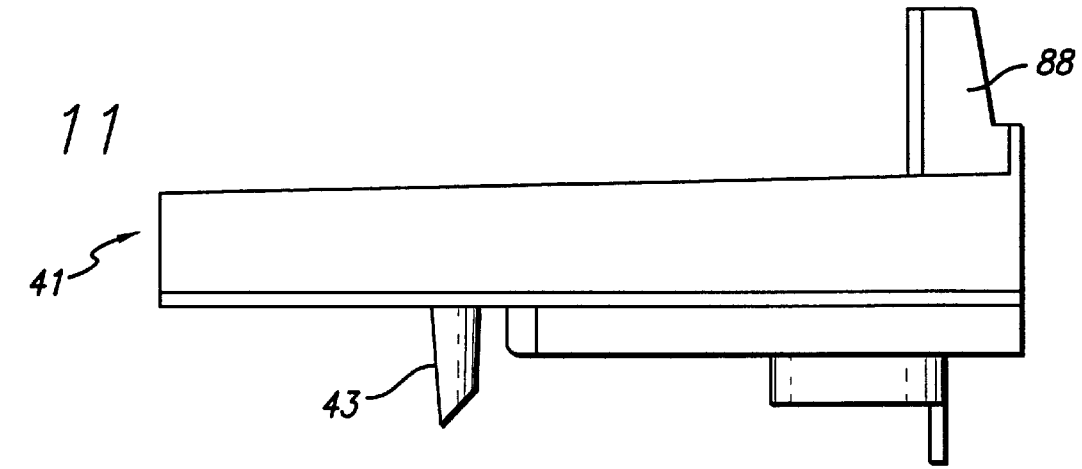
FIG. 11 is a side elevational view of the platform of the dispenser.

In the preferred embodiment of the invention, the liquid retained in the connector 56 is cooled by a thermal plate 65, which is positioned on top of the platform 41 as shown in FIGS. 3 and 4. The plate 65 is preferably made of a metal material and generally shaped in a rectangular, flat form with a protruding extension 67, as shown in FIG. 5. The extension 67 preferably corresponds in shape to a channel 68 in the platform 41 and extends through the channel 52 of the clamping member 50. A passage 70 extending through the protruding extension 67 accommodates the connector 56 so that the connector is pressed against the side of the passage 70 when the clamping member 50 is in the closed position (FIG. 9). In this manner, liquid retained in the passage 57 of the connector 56 is cooled by the plate 65. This thermal regulation not only provides a cooled product, but also aids in preventing any microbial growth in the passage 57.

In a preferred embodiment the protruding extension 67 of the thermal plate 65 contains a slotted channel 72 which extends a short distance, preferably less than halfway into the extension 67 as illustrated in FIGS. 6 through 9. The slotted channel 72 is positioned in the same or similar plane as the gate 53, so that the gate 53 (which extends into the channel 52 of the sliding closure 50) correspondingly fits into the slotted channel 72. In operation, as shown in FIG. 9, when the clamping member 50 is in the closed position the coil spring 54 holds the gate 53 in a direction toward the slotted channel 72 to clamp or pinch together a portion of the passage 57 of the connector 56. This prevents the gravity flow of the liquid and also prevents exposure to ambient air of the liquid contained in the connector passage 57 above the pinched portion. As shown in FIG. 8, when the faced end 51 of the clamping member 50 is depressed by a user, the spring 54 is compressed further and the gate 53 is disengaged from the connector 56 to open the passage 57 and to permit the gravity flow of the liquid from the container 45.

The container 45 may be made of any conventional means known in the art, such as a flexible plastic container, a rigid plastic or wax coated paper container, provided that the container is fitted with a connector 56. A variety of container sizes may be accommodated in the dispenser and held. The container may be a refillable container or it may be a disposable container.

FIG. 3 illustrates one preferred embodiment of the platform 41 and the container 45. The container 45 comprises a box-shaped frame 150 for holding a disposable plastic bag or liner 152 that contains liquid to be dispensed. The container frame 150 preferably includes a slidably removable wall 154 to allow for loading of the plastic bag 152 into the frame 150. The removable wall 154 is removed from the frame 150 by sliding it in the direction of arrow A off the frame 150 and is replaced by sliding it onto the frame 150 in a reverse manner. The plastic bag 152 includes a plastic fitment 156, as is known in the art, to which the connector 56 is mounted so that the interior of the plastic bag 152 is in fluid communication with the interior of the connector 156. A slot 158 in the bottom of the container frame 150 slidingly receives and holds the fitment 156 so than the connector 56 projects below the bottom of the frame 150.

FIG. 4 illustrates another embodiment of the platform 41 having adjustable guide means to accommodate more than one size of liquid container 45. In this embodiment, adjustable guide means 80 having guide posts 81 are positioned in openings 82 in the platform 41. The openings 82 have a corresponding shape to the guide posts 81 of the guide means 80. The guide means 80 contain three generally vertical side walls positioned in such a manner that a center wall 85 is opposing to the two end walls 84, 86 as illustrated in FIG. 4. This configuration of the guide means 80 permits the user to remove the guide means 80 from the platform 41, turn the guide means 80 and reposition the means 80 in the platform 41. The adjustable guide means 80 together with stationary guide means 88 provide the means to change the size of the area to be occupied by the container 45 from a larger volume container to a smaller one and to return to an original configuration. An example liquid container and tapping stem suitable for use with this embodiment is disclosed in U.S. Pat. No. 5,855,298, issued to Charles F. Teetsel, III.

Referring to FIG. 2, a preferred embodiment of the dispenser is adapted to dispense liquid from a plurality of containers 45 at one time. In this embodiment, the storage compartment 32 is sized to accommodate the plurality of containers 45. The dispenser is adapted to hold a plurality of platforms 41 in the storage compartment 32. The dispenser also includes a plurality of drain channels 48, clamping members 50, cooling pates 65, connectors 56, catch basins 42 and drain spouts 43 for providing the structure disclosed above for each of the plurality of containers 45. The embodiment shown in FIG. 2 utilizes the platform configuration of FIG. 4. It will be understood, however, that the platform configuration of FIG. 3 also may be used for any of the plurality of platforms 41 in the storage compartment.

Temperature control of the storage compartment 32 can be provided by any means known in the art. Referring again to FIG. 1, in the preferred embodiment of the dispenser, temperature control of the storage compartment 32 is provided by a conventional hermetic refrigeration system using a compressed gas. This system includes a compressor 160 mounted in the rear compartment 34 on a compressor support 161 and connected, via a refrigerant line 162, in fluid communication with evaporator coils 164 mounted in the storage compartment 32. The compressor 160 is connected via another refrigerant line 166 to condenser coils 164 mounted in the rear compartment 34. An insulating block 167 helps insulate the storage compartment 32 from the rear compartment 34. An evaporator fan 168 is mounted in the storage compartment 132 adjacent the evaporator coils 164 to circulate air in the storage compartment 32 over the evaporator coils 164. A condenser fan 169 is mounted in the rear compartment 34 adjacent the condenser coils 164 and is adapted to circulate external air over the condenser coils 164. The compressor 160 includes a power supply that provides electric power to operate the evaporator fan 168 and the condenser fan 169 as well as the compresser itself. A thermostat 170 includes a control mechanism 172 located outside of the storage compartment in any suitable location that is accessible to the user. The thermostat 170 also includes a temperature sensor 174, which is located inside the storage compartment 32 and is coupled to the control mechanism 172 via coupling line 176. In a preferred embodiment, the thermostat 170 is a solid state thermostat. One suitable refrigeration system has been provided by Blissfield Manufacturing Co., of Blissfield, Mich. The refrigerant line 162 and the temperature sensor coupling line 176 are closely fitted through a channel in the insulating block 167 that extends between the storage compartment 32 and the rear compartment 34. Preferably, the insulating block is made of an insulating material in which it is easy to form such a channel, such as Styrofoam. In this configuration, the temperature of the storage compartment 32 can be controlled by the thermostat control 172. Temperature control of the storage compartment 32 also is improved by providing thermal insulation 114 in the interior of the base 24, the top 26, the cover 36 and the partition 30 of the housing 22, as discussed above.

Figure 12:
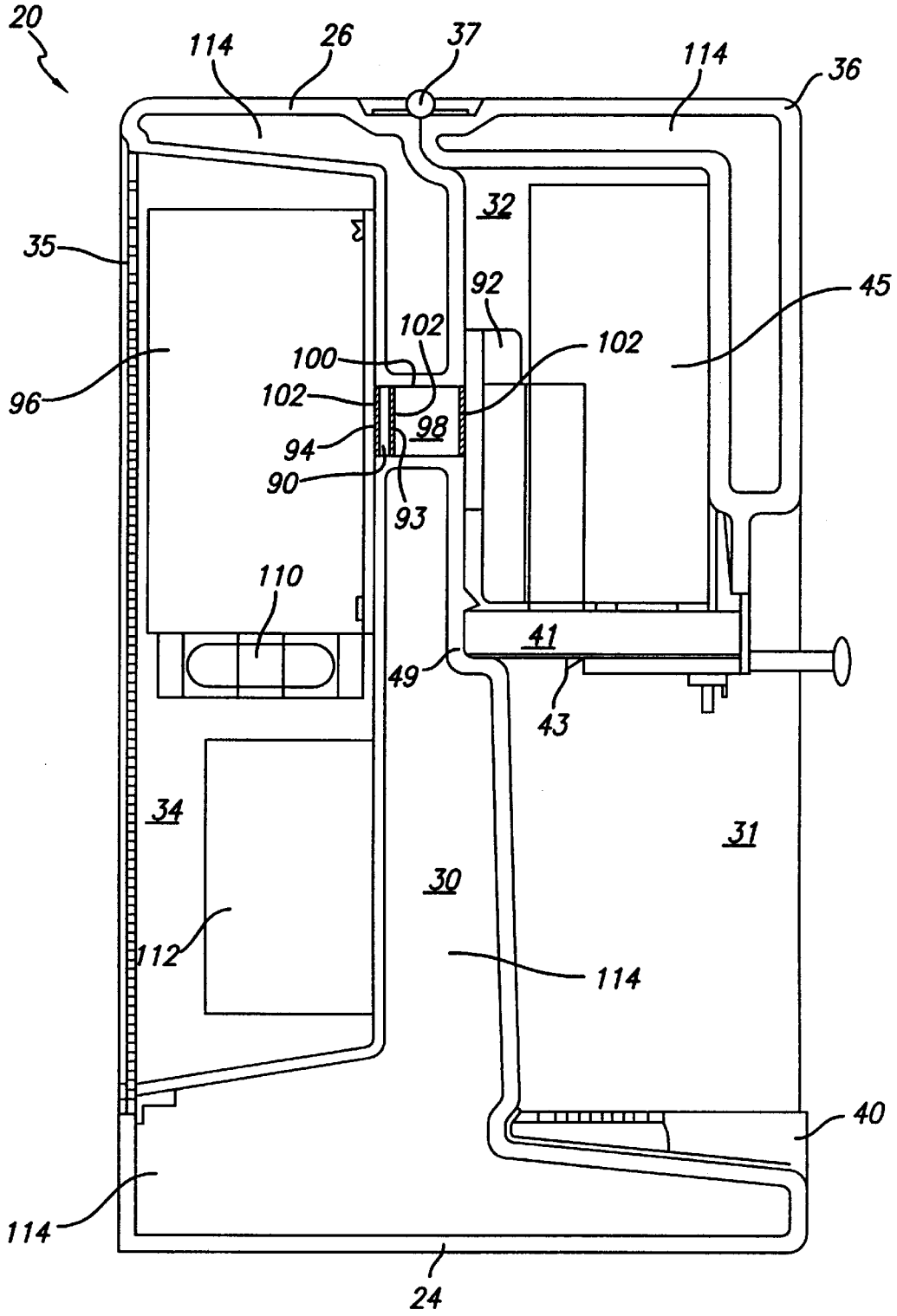
FIG. 12 is a sectional side view of an alternative embodiment of a dispenser in accordance with the invention.

FIG. 12 illustrates an embodiment of a dispenser in which temperature control is provided by means including a thermoelectric module 90 adapted to enable transfer of thermal energy between the storage compartment 32 and the external environment of the liquid dispenser 20. A cold plate 92 is mounted inside the storage compartment 32 on the partition 30, and a heat sink 96 is mounted inside the rear compartment 34 on the partition 30. The cold plate 92 is positioned in overlying relation to the catch basin 42 for collecting condensation from the cold plate. A hot side 94 of the thermoelectric module 90 is thermally coupled to the heat sink 96, and a cold side 93 of the thermoelectric module 90 is thermally coupled to a thermal transfer block 98, which is closely positioned within a shaft 100 extending through the partition 30 and is also thermally coupled to the cold plate 92. The cold plate 92, the thermal transfer block 98, and the heat sink 96 are composed of material having suitable thermal conductivity, preferably aluminum or copper. Thermal coupling of these elements is enhanced by applying a thermally conductive medium 102, such as thermal epoxy, thermal grease or thermal pads between the surfaces of the elements where they interface each other and the thermoelectric module 90.

A fan 110 is mounted in the rear compartment 34 adjacent the heat sink 96 and is adapted to move air over the heat sink 96. A power supply 112 provides electric power to operate the fan 110 and the thermoelectric module 90. In this configuration, the temperature of the storage compartment 32 can be controlled by regulating the power to the thermoelectric module 90 using conventional means, preferably a thermistor mounted in the cold plate 92, a feedback loop and power supply control circuitry. Temperature control of the storage compartment 32 is improved by providing thermal insulation 114 in the interior of the base 24, the top 26, the cover 36 and the partition 30 of the housing 22, as discussed above. The desired temperature control may be achieved with only one thermoelectric module 90. Alternatively, multiple thermoelectric modules 90 can be used for improved thermal transfer capacity.

Again referring to FIG. 3, in operation, a container of liquid 45 is loaded into the dispenser 20 by moving the container 45 downward into contacting relation with the container pedestals 47 of the platform 41. When so loaded, connector 56 will extend through the channel 68 of the platform 41, out the cooling plate 65 and through the channel 52 of the sliding closure forming a communication from the interior of the container 45 to a vessel 60 to receive the liquid. After the container 45 is placed in this loaded position, the upper end of the container 45 is opened or punctured to allow entry of air into the container 45 to enable the liquid to flow freely when dispensed. Likewise, the container 45 shown in FIG. 4 is loaded by positioning the container 45 within the guides 88 and adjustable guide means 80 and by moving the container 45 downward into contacting relation with the container pedestals 47 of the platform 41.

Referring to FIGS. 8 and 9, liquid is dispensed from the container 45 and out of the connector 56 by pushing the clamping means 50 toward the dispenser 20 to coil the spring 54 causing the gate end 54 of the gate 53 to release the pressure on the connector 56, thereby allowing gravitational flow of liquid from the container 45 through the connector 56 to the vessel 60. When the slide means 50 is released by the user, the coil spring 54 uncoils causing the gate end 54 to compress the connector 56 and restrict the flow of liquid. When the container 45 is empty, it can be removed by horizontally sliding the clamping means 50 away from the dispenser 20 and removing the container 45 and the connector 56 attached thereto, from the platform 41. Any leakage of liquid from the container 45 when it is removed will drain into the catch basin 42, through the drain spout 43 and into the drip tray 40. The empty container 45 can be disposed of after it is removed from the dispenser and replaced with a new full container after replacement of the stem 50 and the tube 58.

To facilitate cleaning of the dispenser, the platform 41, the connector 56 and the clamping means 50 may be removed from the housing 22 and disassembled. For convenience, the connector 56 may be disposed of, rather than cleaned, and replaced with a connector 56.

The above-described structure possesses several advantages. It is convenient to use and clean because, among other reasons, the liquid dispenser can utilize disposable containers, the platform 41, the connector 56, and the clamping means 50 can be easily dissasembled for cleaning and the connector 56 can be disposable. Generally, only the container 45 and the connector 56, both of which can be disposable, come into extensive contact with the liquid, thereby reducing cleaning and maintenance requirements. The dispenser can be constructed of relatively inexpensive materials. Moreover, the disclosed dispenser structure is compact in size and can dispense liquid from multiple containers at one time.

Although our invention has been described in considerable detail with reference to certain preferred embodiments thereof, it will be apparent to those of ordinary skill in the art that various modifications and adaptations to those embodiments are possible. For example, the liquid dispenser, the thermoelectric module 90 and associated elements may be configured to heat the storage compartment 32, rather than cool it. In yet another alternative configuration, the storage compartment 32 may be cooled by providing a eutectic cooling device removably mounted inside the storage compartment 32 as the temperature control means. Therefore, the spirit and scope of the appended claims should not necessarily be limited to the exact construction and operation shown and described, and accordingly, all suitable modifications and equivalents may be resorted to, falling within the scope of the invention.

What is claimed is:

1. A liquid dispenser for use with a removable liquid supply container, the liquid dispenser comprising:

a. clamping means for regulating the flow of liquid from the dispenser and substantially sealing the liquid in the container from ambient air;

b. support means for holding the container in a substantially elevated position above the clamping means, the support means having guide means for adjusting an area in which the container is positioned in the dispenser to accommodate at least two volume sizes of the container; and c. connector means having a passage extending from an opening end through the clamping means to a discharge end, the connector means for communicating with the interior of the container to permit the gravity flow of liquid from the container and out of the discharge end.

2. The liquid dispenser according to claim 1 wherein the clamping means further comprises a sliding member for clamping a portion of the passage of the connection means in a closed position to prevent the flow of the liquid from the dispenser and to disengage the portion of the passage to permit the flow of the liquid from the dispenser in an open position.

3. The liquid dispenser according to claim 2 wherein the sliding member includes a channel that accommodates the passage of the connector means.

4. The liquid dispenser according to claim 3 wherein the dispenser further comprises a cooling plate positioned between the clamping means and the liquid supply container, the cooling plate used to cool the liquid exiting from the container through the passage of the connector means.

5. The liquid dispenser according to claim 4, wherein the cooling plate comprises a metallic plate with a protruding knob which correspondingly fits into the channel of the clamping means to position the plate between the clamping means and the container.

6. The liquid dispenser according to claim 5, wherein the protruding knob of the plate comprises an opening to accommodate the passage of the connector means.

7. The liquid dispenser according to claim 1 wherein the guide means comprises at least two opposing peripheral flanges positioned on the support means, one of the flanges being stationary and the other flange being removable to adjust the area to be occupied by the container to the at least two volume sizes of the container.

8. A liquid dispenser for use with a removable liquid supply container, the liquid dispenser comprising:

a. clamping means for regulating the flow of liquid from the dispenser and substantially sealing the liquid in the container from ambiant air;

b. support means for holding the container in a substantially elevated position above the clamping means, the support means having guide means for adjusting an area in which the container is positioned in the dispenser to accommodate at least two volume sizes of the container;

c. connector means having a passage extending from an opening end through the clamping means to a discharge end, the connector means for communicating with the interior of the container to permit the gravity flow of liquid from the container and out of the discharge end; and d. cooling means positioned between the clamping means and the liquid supply container, the cooling means used to cool the liquid exiting from the container through the passage of the connector means.

9. The liquid dispenser according to claim 8 wherein the clamping means further comprises a sliding mechanism which is spring activated to clamp a portion of the passage of the connection means in a closed position to prevent the flow of the liquid from the dispenser and to disengage the portion of the passage to permit the flow of the liquid from the dispenser in an open position.

10. The liquid dispenser according to claim 9 wherein the sliding mechanism comprises a channel which accommodates the passage of the connector means.

11. The liquid dispenser according to claim 8, wherein the cooling means comprises a metallic plate with a protruding knob which correspondingly fits into the channel of the clamping means to position the plate between the clamping means and the container.

12. The liquid dispenser according to claim 11, wherein protruding knob of the plate comprises an opening to accommodate the passage of the connector means.

13. The liquid dispenser according to claim 8 wherein the guide means comprises at least two peripheral flanges positioned on the support means, one of the flanges being stationary and the other flange being removable to adjust the area to be occupied by the container to the at least two volume sizes of the container.

14. A method for regulating the flow of liquid from a liquid supply container comprising the steps of:

a. positioning a liquid supply container on support means for holding the container of the liquid dispenser, the support means having guide means for adjusting an area in which the container is positioned to accommodate at least two volume sizes of the container;

b. opening a clamping means of the dispenser for regulating a gravity flow of a liquid from the dispenser through a connector means for communicating with the interior of the container and into a selected vessel; and c. cooling the liquid of the gravity flow as it leaves the container.

15. The method according to claim 14 wherein the opening step further comprises applying tension to a sliding mechanism of the clamping means to move the sliding mechanism from a closed position to an open position to regulate the gravity flow of the liquid.

16. The method according to claim 14 wherein the guide means used in the positioning step further comprises at least two peripheral flanges positioned on the support means, one of the flanges being stationary and the other flange being removable to adjust the area to be occupied by the container.

* * * * *